US006478527B2

(12) United States Patent
Silvan

(10) Patent No.: US 6,478,527 B2
(45) Date of Patent: Nov. 12, 2002

(54) LOADING AND COMPACTING DEVICE FOR THE TRASH CONTAINER OF A TRASH-COLLECTING VEHICLE AND A WORKING METHOD THEREFOR

(76) Inventor: Eckhard Silvan, Kurparkalle 4, 15834 Rangsdorf (DE)

( * ) Notice: Subject to any disclaimer, the term of this patent is extended or adjusted under 35 U.S.C. 154(b) by 0 days.

(21) Appl. No.: 10/151,662

(22) Filed: May 20, 2002

(65) Prior Publication Data

US 2002/0136622 A1 Sep. 26, 2002

Related U.S. Application Data

(63) Continuation of application No. 09/501,047, filed on Feb. 9, 2000, now abandoned.

(30) Foreign Application Priority Data

Feb. 12, 1999 (DE) ..... 199 05 986

(51) Int. Cl.[7] ..... B65F 3/20
(52) U.S. Cl. ..... 414/525.53; 414/813
(58) Field of Search ..... 414/525.5, 525.51, 414/525.52, 525.53, 525.54, 525.55, 813

(56) References Cited

U.S. PATENT DOCUMENTS

| | | | | |
|---|---|---|---|---|
| 3,696,951 A | * | 10/1972 | Toppins et al. | 414/525.54 |
| 3,746,192 A | * | 7/1973 | Herpich et al. | 414/525.52 |
| 3,881,613 A | * | 5/1975 | Torimoto et al. | 414/525.51 |
| 4,298,306 A | * | 11/1981 | Chaudorge | 414/525.51 |
| 4,460,307 A | * | 7/1984 | Durant et al. | 414/525.54 |
| 4,863,336 A | * | 9/1989 | Gasparini | 414/525.54 |

FOREIGN PATENT DOCUMENTS

| | | | | |
|---|---|---|---|---|
| DE | 2444771 | * | 4/1976 | |
| EP | 691289 | * | 1/1996 | |
| FR | 2575143 | * | 6/1986 | 414/525.52 |
| GB | 2152898 | * | 8/1985 | 414/525.53 |
| JP | 63-282002 | * | 11/1988 | 414/525.53 |
| JP | 1-271304 | * | 10/1989 | 414/525.54 |
| NL | 93943 | * | 4/1960 | 414/525.5 |
| WO | 86/06351 | * | 11/1986 | 414/525.53 |

* cited by examiner

*Primary Examiner*—James W. Keenan
(74) *Attorney, Agent, or Firm*—Cesari and McKenna LLP

(57) ABSTRACT

A loading and compacting method and device for the trash container of a trash-collecting vehicle and a working method for such, wherein the trash container has a rear fill opening. The loading and compacting device has a loading bin coupled to the trash container on the back and a press plate, which is mounted on its upper end on an axis transverse to the longitudinal direction of the vehicle that can swivel in the back part in a swivel bearing, which can move parallel to the plane of the fill opening, plus a cleaning plate which is also mounted on an axis transverse to the longitudinal direction of the vehicle and can swivel on the free end of the press plate, and a first force element to swivel the press plate. The goal is to provide a loading and compacting device with a large load volume, a high compacting capacity, optimal loading and the least possible stress on the trash container structure.

7 Claims, 5 Drawing Sheets

LOADING AND COMPACTING DEVICE FOR THE TRASH CONTAINER OF A TRASH-COLLECTING VEHICLE AND A WORKING METHOD THEREFOR

RELATED APPLICATION

This application is a continuation of Ser. No. 09/501,047, filed on Feb. 9, 2000, now abandoned.

BACKGROUND OF THE INVENTION

This invention concerns a loading and compacting device for the trash container of a trash-collecting vehicle, which has an opening in back for filling and a plate for emptying that moves longitudinally in the trash container, against which trash that is put in is compacted, with a hinged back part that can swivel on the trash container that is designed as a loading bin on the bottom part, with a press plate mounted on its upper end on an axis transverse to the longitudinal direction of the vehicle in the back part in a swivel bearing that can move parallel to the plane of the fill opening, with a cleaning plate that is also coupled to the free end of the press plate and can swivel in the longitudinal direction of the vehicle and a first force element to swivel the press plate.

This invention also concerns a working method for a back-loading and compacting device for the trash container of a trash-collecting vehicle, which has a back part designed as a loading bin on the lower part, and has a plate mechanism comprised of a press plate and a cleaning plate, wherein the press plate is mounted on its upper end on an axis that is transverse to the longitudinal direction of the vehicle so it can swivel in a swivel bearing parallel to the plane of a fill opening, and the cleaning plate is also coupled on an axis running transverse to the longitudinal direction of the vehicle so it can swivel on the free end of the press plate; it has a first force element to swivel the press plate, a second force element to move the swivel bearing and a third force element to swivel the cleaning plate relative to the press plate; and in the starting position of the working method, the swivel bearing of the plate mechanism is in the upper end position, the plates are extended or almost extended to one another, and the press plate is swiveled all the way up.

These types of loading and compacting devices are known and are used to convey and compress trash emptied into the loading bin in the trash container. Two plate apparatus are known in the general state of the art as loading and compacting devices; they have a guide or carrier plate and a press and cleaning plate hinged to it, and the guide plate can move exclusively in a linear direction. For this known loading and compacting device to be able to perform its function, the guide plate is moved from the upper end position, with the press and cleaning plate open, across and down in the direction of the loading bin, so the press and cleaning plate for cleaning out the loading bin is then swiveled in the direction of the fill opening of the trash container and in that position is moved up at an angle along with the guide plate. One disadvantage of this design is that because of the direction of movement of the two-plate mechanism, the loading and compacting are not horizontal to the longitudinal direction of the trash container. Another is that the cycle volume for effective loading and compacting performance, which means the volume moved by the loading and compacting device in one work phase, is limited by the swivel radius of the press and cleaning plate and the path of the guide plate. Another disadvantage of this known loading and compacting device is that there are very high stresses on the roof part of the trash container due to the direction of the compacting force.

In another embodiment of a loading and compacting device in the general state of the art, the carrier plate is an integral part of a four-bar mechanism and is designed as a coupling element. The type of construction and layout of the four-bar mechanism here also allows only an approximately linear angular upward movement and a slight movement of the carrier plate in the horizontal direction. This known loading and compacting device is not very different from the other embodiment just described.

Finally, a loading and compacting device is known from the general state of the art that is composed of a single plate hinged to a swivel frame which first cleans out the loading bin when the swivel frame is lowered and then when the swivel frame is raised conveys the trash into the trash container and compacts it. The disadvantage of this embodiment is that the plate cannot extend over the entire width of the back part, since there must be enough room for the swivel frame on the side.

A loading and compacting device is known from EP 0 149 436 A1 which is comprised of only one plate, which performs the cleaning and compacting function. One end of this plate is connected to a coupler attached so it is hinged in place in back. A hydraulic cylinder drives the coupler on a circular path and allows the position of the swivel point of the cleaning and press plate to change on the circular path. Another hydraulic cylinder is coupled to the cleaning and press plate and allows them to swivel around the point of rotation provided by the corresponding couple setting. The design of the compacting unit as an seamless plate and the plate kinematics provided by the spatial layout and dimensional design of the coupler element and hydraulic cylinder give the trash-collecting vehicle a relatively small loading-cycle volume and thus a low load capacity.

A loading and compacting vehicle is also known from EP 0 691 289 A1 which is composed of a carrier plate and a cleaning plate connected to it that is hinged on the bottom end. The carrier plate is mounted on slanted runners in back so it can move linearly on one end, and there is a connecting point for a coupler coaxial to the turning point of the cleaning plate that is connected on the back at its other hinge point. For the loading process, the carrier plate is moved by a hydraulic cylinder on the runners, while it simultaneously makes a slight swivel movement provided by the coupler. The actual loading and compacting process is basically carried out only by the cleaning plate. The loading action is not significantly different from the embodiments described at the beginning with a linear carrier plate, since there is a quasilinear movement and the trash is conveyed and compacted up at an angle.

U.S. Pat. No. 3,746,192 discloses, for example in FIG. 3, a loading and compacting device for the trash container of a trash-collecting vehicle, which has a rear fill opening and an emptying plate that moves longitudinally in the trash container, against which the filled trash is compacted. The back part is mounted so it can swivel on the back of the trash container and is designed as a loading bin in the lower area. A press plate is also provided, which is mounted in a swivel bearing on an axis transverse to the longitudinal direction of the vehicle that can swivel on the back part, and a first force element to swivel the press plate. The swivel bearing of the press plate is arranged so it can move on the back part, and the first force element grasps onto the side of the press plate on the side away from the fill opening and on the end of the back part in the roof area. In any case, the press plate here is designed to be one-piece with a top part and a bottom part, which form an angle of roughly 140° with one another.

Finally, DE-OS 24 44 771 discloses a loading and compacting device for the trash container of a trash-collecting vehicle with the features mentioned above. In one example of embodiment shown in FIG. 8, a force element (339) is provided to swivel the press plate (315).

All the loading and compacting devices mentioned above have the common disadvantage that the positions of the elements that are active during the work cycles, namely the press plate and the cleaning plate, if there are any, remain unchanged to one another during work phase II, the compacting phase. If there is only one active element (as in U.S. Pat. No. 3,746,192), it is L-shaped, so that both cleaning and compacting are possible. But in both configurations, the active areas of the plate mechanism facing the fill opening of the trash container form a more or less obtuse angle during the entire compacting phase, which is a disadvantage that results in the fact that the volume created by the obtuse angle between the plate mechanism and the trash container cannot be used for the compacting process.

SUMMARY OF THE INVENTION

The problem of this invention is to improve a loading and compacting device of the type mentioned at the beginning and a working method for it in a way that guarantees a large loading volume per work phase, optimal loading, high compacting of the trash and thereby less stress on the trash-container structure.

This problem is solved by the invention with a loading and compacting device with the features mentioned in the beginning, so that the first force element is mounted on the side of the press plate away from the fill opening and on the end of the back part in the roof area; and the press plate and the cleaning plate positioned with it, when they are in the press position, take a position parallel to or in the plane of the fill opening; and the cleaning plate, in the press position, when the fill opening is closed by the press plate and the cleaning plate, forms an angle $\alpha$ of 180° or approximately 180° with the press plate.

This problem is also solved with a working method of the type mentioned at the beginning with the following steps:

a) in phase I, the plate mechanism is in the fill position, in which the swivel bearing of the press plate is moved down; b) in phase II, the press plate is moved part way down and the cleaning plate is swiveled relative to the press plate in the direction of the fill opening of the trash container, until the lower edge of the cleaning plate lies roughly in the plane of movement of the press plate swivel bearing, and c) in phase III, compacting takes place by an overlapping movement of the press plate and the cleaning plate, by moving the press plate swivel bearing up and hence the press plate and at the same time swiveling the press plate and the cleaning plate in the direction of the fill opening until the plates are extended or almost extended to one another in the plane of movement of the press plate swivel bearing.

The solutions in the invention have one decisive advantage: since phase II, namely the compacting phase, is comprised of an overlapping movement of both active plate elements involved, when the press plate is moved up and swiveled, at the same time, the position of the cleaning plate changes in relation to the press plate in such a way that the volume between the plates and the trash container approaches zero, namely when the cleaning plate and the press plate both form one plane and are parallel to the fill opening of the trash container. This overlapping movement clearly improves the compacting of the trash in the trash container. The important thing here is that the press plate and the cleaning plate positioned with it in the press position take a position parallel to or in the plane of the fill opening of the trash container.

Advantageous variations of the invention are given in the dependent claims.

Preferably, a pair of runner running parallel to the direction in which the fill opening runs are attached on the back part, where the swivel bearing of the press plate is mounted, so it can move. These runners allow especially maintenance-free, trouble-free operation of the loading and compacting device, compared to a spindle guide or the like.

To position the swivel bearing of the press plate in the back part, a pair of two force elements is preferably connected on one side to the back part and on the other side to the press plate. The part of the pair of two force elements connected to the press plate grasps the axis of the swivel bearing here, and its directions of force correspond approximately to the longitudinal direction of the pair of runners. The positioning cylinders are thus mounted on the outside walls of the back part and do not come in contact with the trash being loaded.

The cleaning plate hinged to the press plate is swiveled by means of a third force element, depending on the position of the press plate, and cleans the loading bin with its swivel movement in the direction of the fill opening of the trash container. This third force element can, of course, also be arranged in pairs symmetrically on the side facing away from the trash.

One advantageous variation of the method consists of the fact that the piston/cylinder position of the first force element does not change during phase III. It can be seen here that the movement completed by the press plate during the loading cycle could be performed, besides the possibility described, by means of two pairs of force elements (a first force element and a second force element, in pairs) also by means of a combination of a pair of force elements and a coupler.

Finally, it is definitely clear to a person skilled in the art that the processes of movement in the individual phases of the loading cycle are carried out with the corresponding control.

BRIEF DESCRIPTION OF THE DRAWINGS

One preferred embodiment of the invention will be explained in greater detail below using the drawings, in which.

DETAILED DESCRIPTION OF AN ILLUSTRATIVE EMBODIMENT

Figure 1:
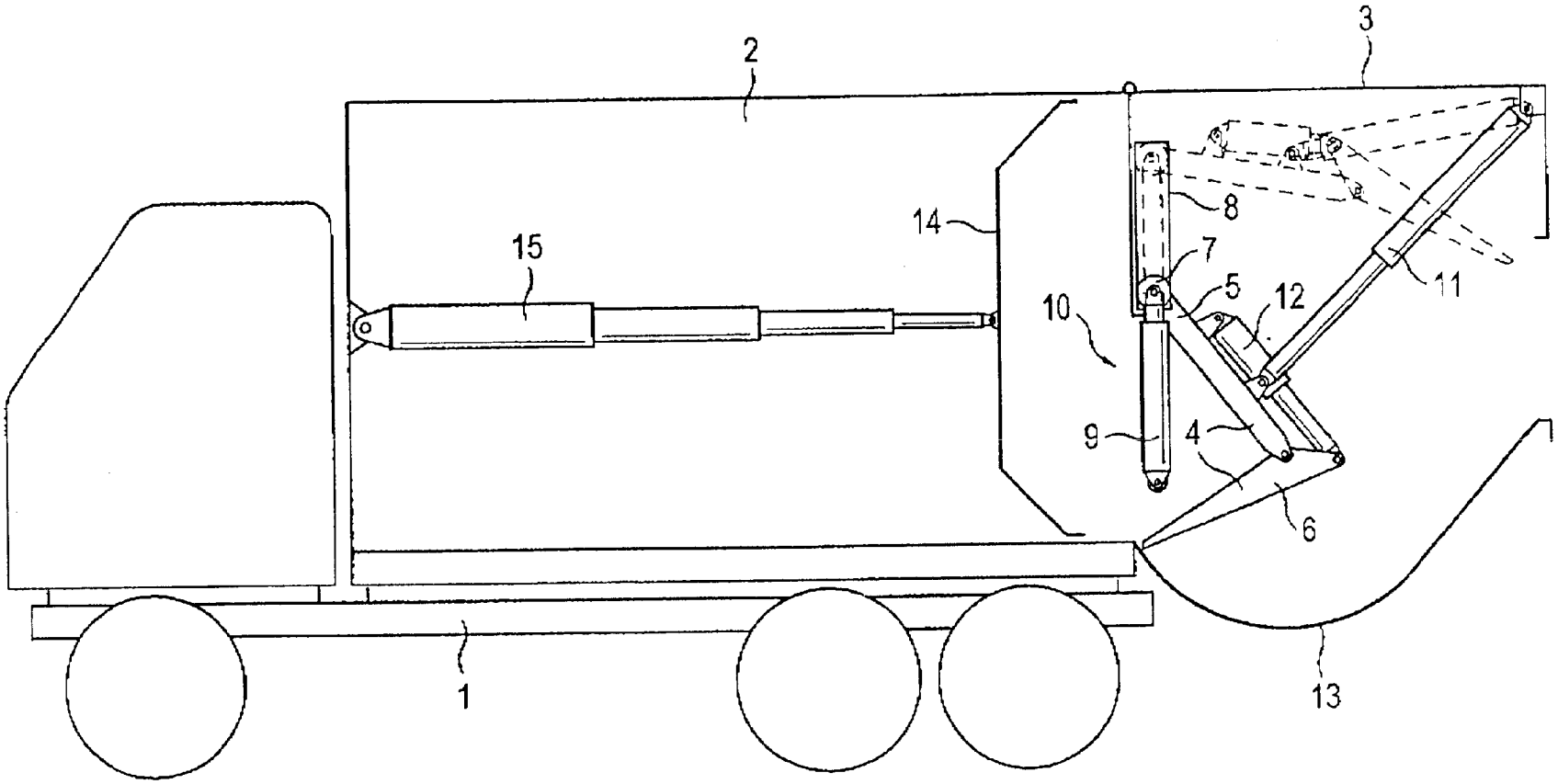
FIG. 1 shows a cut-open side view of a trash-collecting vehicle.

FIG. 1 shows a trash-collecting vehicle 1 with a trash container 2, which has a fill opening 10 in back and an emptying plate 14 that can move longitudinally in the trash container 2 by means of a telescopic cylinder 15, against which the loaded trash is compacted, and a back part 3 that can swivel on the back of the trash container 2, which is designed as a curved loading bin 13 on the bottom part. A loading and compacting device 4 is arranged in the back part 3 which basically consists of a press plate 5 and a cleaning plate 6 that is hinged to it and can swivel. The press plate 5 is connected to the back part 3 via a swivel bearing 7, which is mounted on a pair of runners 8 (of which only the runner on the left side of the vehicle can be seen here), which are connected firmly to the back part 3. The runners 8 are arranged on the back part 3 directly at the point of connection to the trash container 2 on the top part and with a vertical axis that is parallel to the fill opening 10 here. The swivel bearing 7 can move on the runners 8, so that the swivel point of the press plate 5 in the back part 3 can vary in height. Two second force elements 9 formed by piston/cylinder arrangements are used to position the swivel bearing 7; they grasp the swivel bearing 7 directly. Again, only the piston/cylinder arrangement on the left side of the vehicle can be seen in this view. The movements of the press plate 5 and the cleaning plate 6 that are necessary for the loading and compacting process are triggered by the first force element 11 and the third force element 12, which are preferably also designed as piston/cylinder arrangements. Here, the third force element 12 is hinged, on one hand, to the side of the press plate 5 facing away from the fill opening 10, and, on the other hand, near the upper edge of the cleaning plate 6. This allows the cleaning plate 6 to swivel in relation to the press plate 5. The first force element 11 has its abutment in the roof area of the back part 3 and its coupling point at the side of the press plate 5 away from the fill opening 10.

FIGS. 2*a* to 2*e* show a schematic side view of the back part 3 with the loading and compacting device 4 in a series of working positions that will be called phases below and that go through a complete work cycle.

Figure 2B:
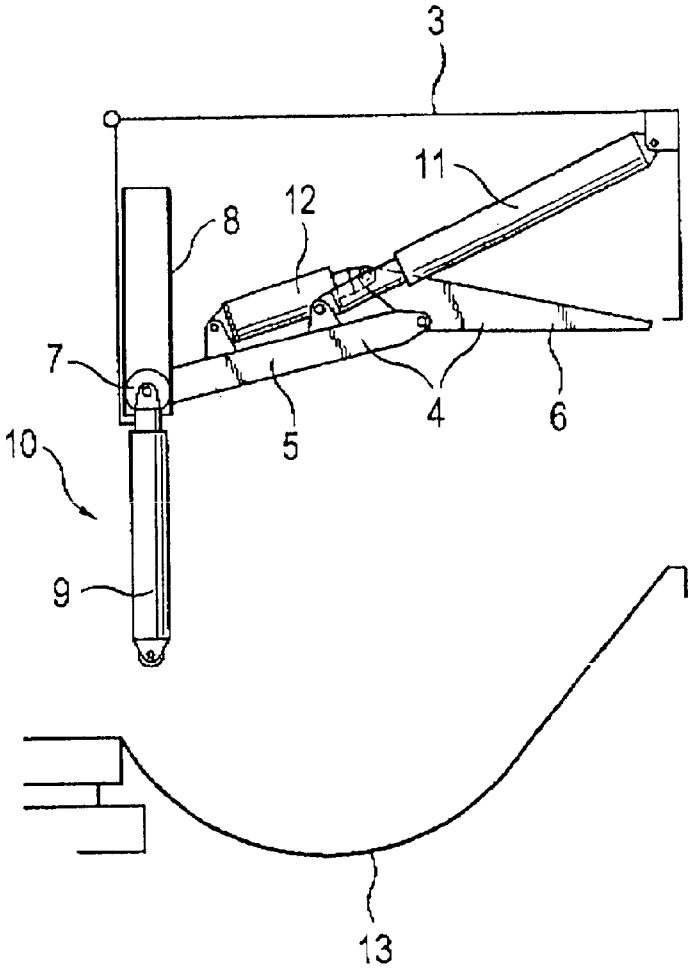
FIGS. 2*a–e* show cut-open side views of the vehicle back part with the loading and compacting device in various working positions.
Figure 2A:
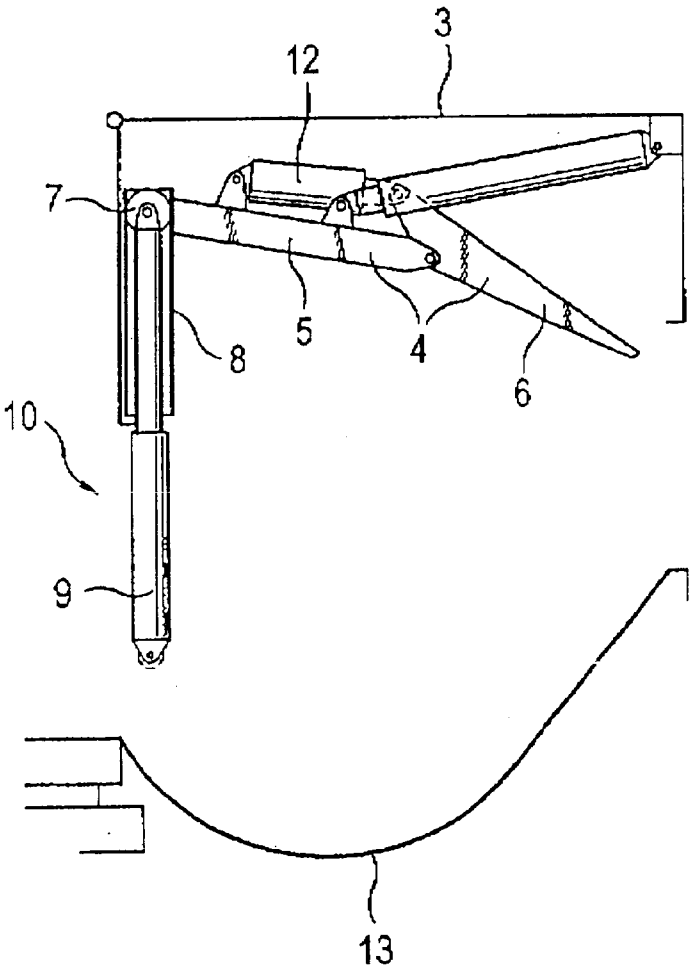

FIG. 2*a* shows the loading and compacting device 4 in its starting position. The piston/cylinder arrangement 9 is out and thus the swivel bearing 7 is in the up position on the runners 8. At the same time, the first force element 11 and the third force element 12 are in, so that the press plate 5 is in the up position and the cleaning plate 6 is in the open position.

FIG. 2*b* shows the first phase. In it, the swivel bearing 7 is moved onto the runners 8 by moving the second force element 9 down. Thus, the swivel point of the press plate 5 is in an optimal position for the rest of the loading and compacting process.

Figure 2D:
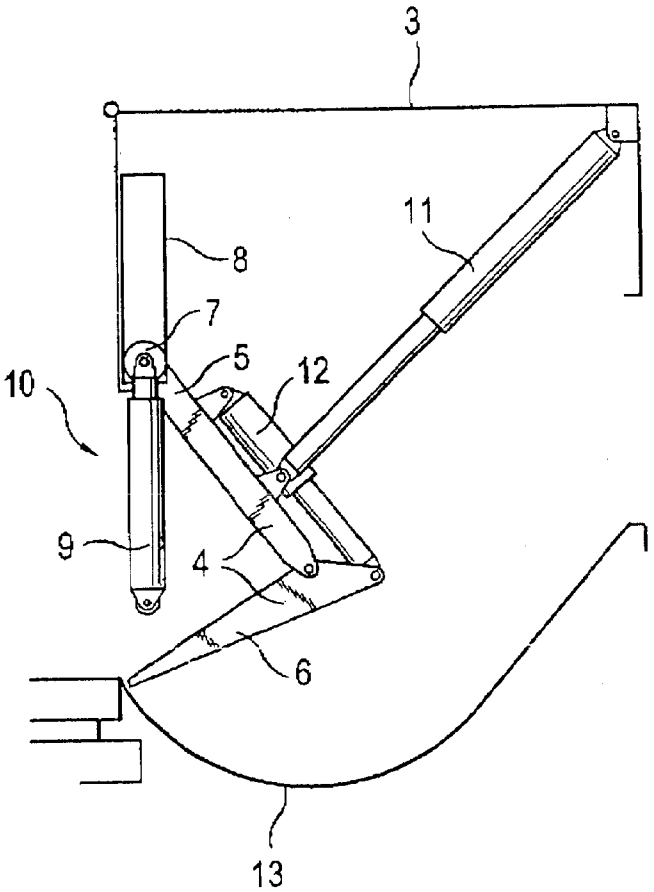
Figure 2C:
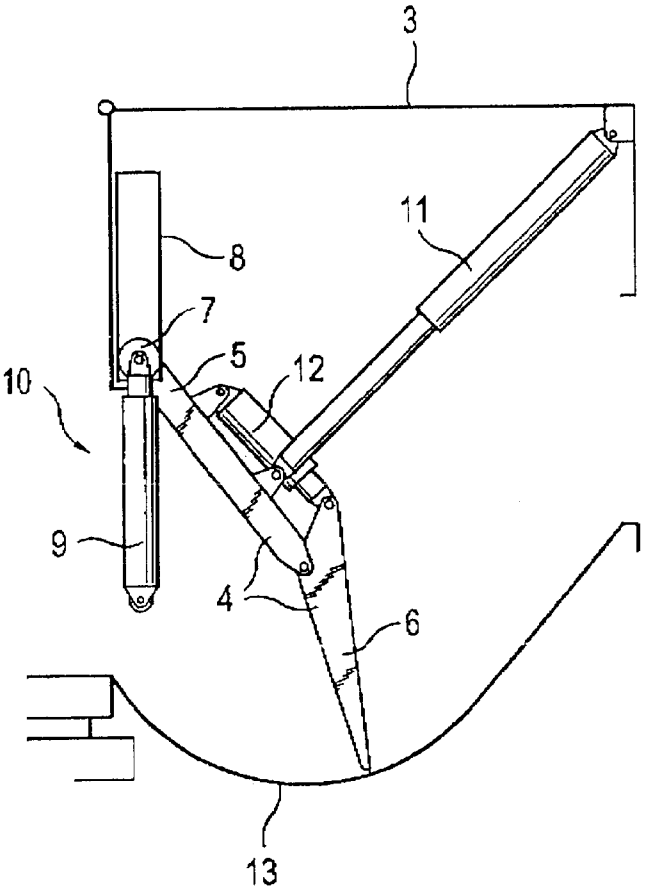

FIG. 2*c* shows the next phase, at the end of which the first force element 11 runs out and the press plate 5 is swiveled into a position in which the center of gravity of the cleaning plate 6 is in the center of the radius of curvature of bin 13. Before this position was reached, due to the swiveling movement of the press plate 5 with the open cleaning plate 6, some of the trash in the loading bin 13 is transported toward the fill opening 10 of the trash container 2.

In FIG. 2*d*, the next phase is over. The cleaning plate 6 is swiveled in by moving the third piston/cylinder arrangement 12 out, and some of the trash in the loading bin 13 is conveyed into the trash container 2 and some more is between the cleaning plate 6, the press plate 5 and the trash container 2. In one especially advantageous embodiment of the invention, the end edge of the cleaning plate 6 in this phase is approximately at the lower closing edge of the trash container 2 and the press plate 5 and cleaning plate 6 define an acute angle.

Figure 2E:
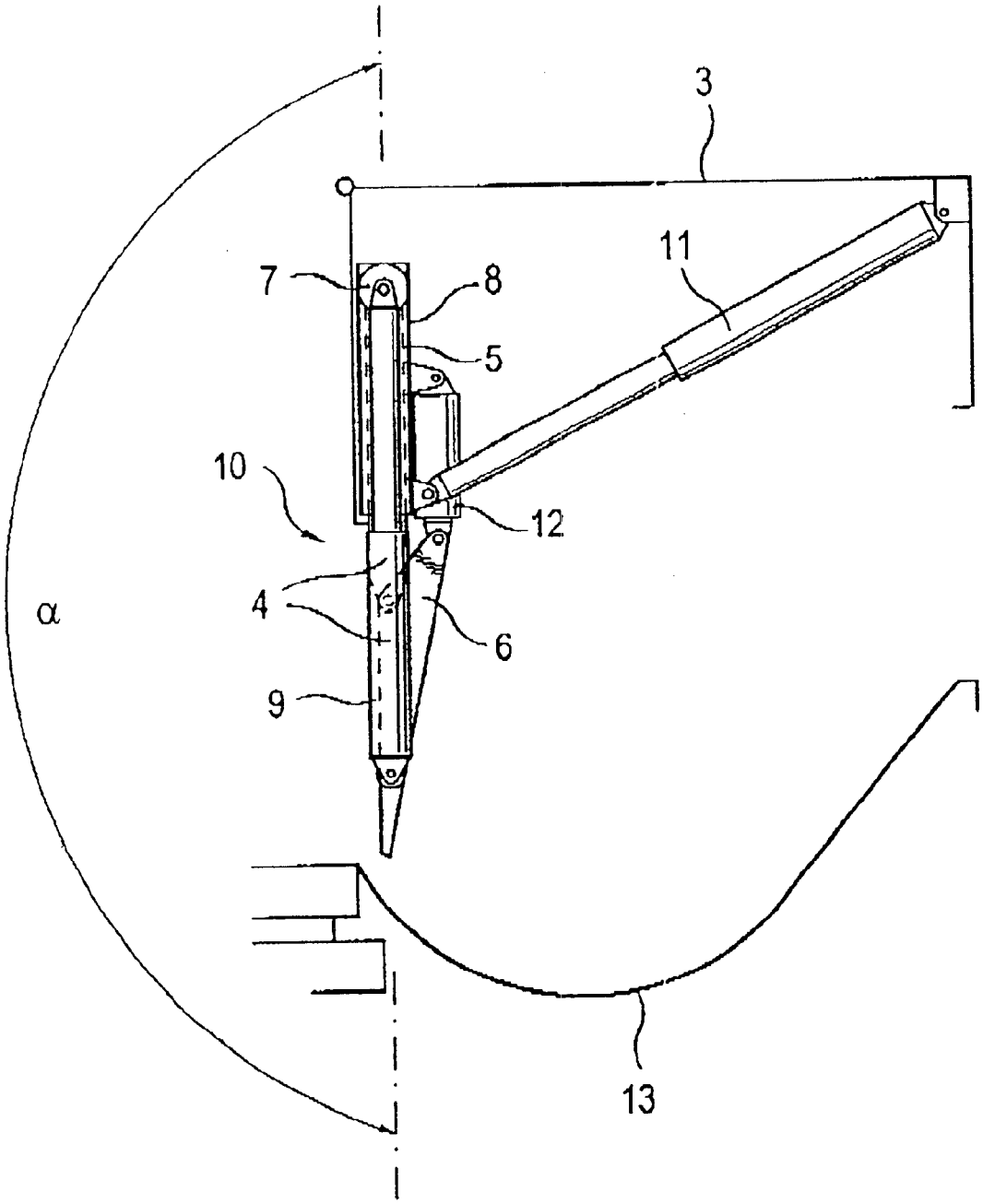

FIG. 2*e* shows the end position of the loading and compacting device 4 after the end of a complete loading cycle. When the second piston/cylinder arrangement 9 comes out, the swivel bearing 7 is pushed up onto the runners 8. The first piston/cylinder arrangement 11, which is out, forms a coupling rod of a linkage having only sliding and turning parts, whose second element is made up of the press plate 5. Due to the special arrangement of the mounting points and the dimensioning of the components, when the swivel bearing 7 moves up, the press plate 5 is swiveled by the first force element 11 onto a circular path around its swivel bearing 7 in the direction of the trash container 2. This swivel movement of the press plate 5 is transmitted to the cleaning plate 6 by the third force element 12, which is arranged between the press plate 5 and the cleaning plate 6, whereby the trash is conveyed through the fill opening 10 into the trash container 2 and at the same time is compacted against the trash already in there and the emptying plate 14. It is a special advantage here that in this press position, hence when the fill opening 10 is closed by the press plate 5 and the cleaning plate 6, the cleaning plate 6 forms an angle $\alpha$ of approximately 180° with the press plate 5. It can be seen from the drawing that the press plate 5 and the cleaning plate 6 positioned with it in this press position basically assume a position in the plane of the fill opening 10. Furthermore, it can be seen that the arrangement of the first piston/cylinder arrangement 11 and the dual, center-folding design of the plate mechanism consisting of the press plate 5 and the cleaning plate 6 provide extremely powerful and hence effective compacting of the trash in the longitudinal direction of the trash container.

Figure 3:
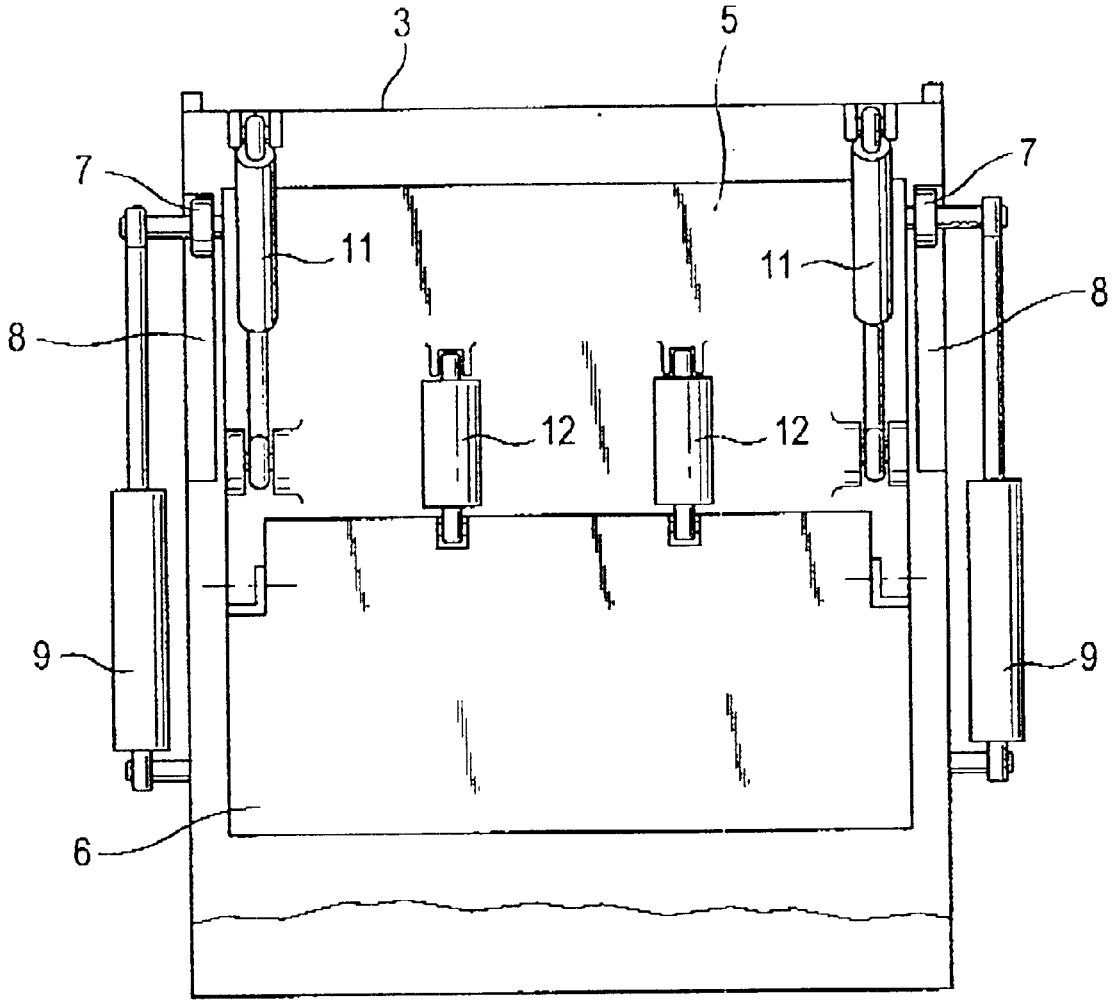
FIG. 3 shows a rear view of the back part.

FIG. 3 shows a rear view of the back part 3. It can be seen from this view that the first force element 11, the second force element 9 and the third force element 12 are each arranged in pairs and are all symmetrical to the center axis of the vehicle.

What is claimed is:

1. A method of loading and compacting trash in a trash container of a trash-collecting vehicle, the container being of the type having a generally rectangular fill opening with upper and lower edges and opposite side edges and a loading bin at the rear of the container and extending to the lower edge of the fill opening, said method comprising the steps of forming an articulated plate having parallel first and second edges and substantially the same shape and dimensions as the fill opening, the plate being composed of upper and lower panels connected by a hinge extending parallel to the first and second edges;

connecting the first edge of the plate by a swivel bearing to the container at the side edges of the opening to allow movement of the plate parallel to the opening as well as swinging movement of the plate about a swivel axis toward and away from the opening;

connecting a first force element between the container and the plate for swinging the plate about the swivel axis;

connecting a second force element between the container and the plate for moving the plate parallel to said opening;

connecting a third force element between the plate panels to pivot the lower panel about said hinge, and controlling said force elements to move the plate from a fully open position wherein the plate extends rearwardly from the upper edge of the fill opening so as to expose the opening and the bin, through a partially closed position wherein the second edge of the plate lies adjacent to the lower edge of the fill opening and the first and second panels define an acute angle, to a fully closed position wherein all three force elements combine to drive the first and second panels into alignment with the opening so that the panels exert a strong net compacting force directed perpendicular to said opening while at the same time substantially closing the opening.

2. The method defined in claim 1 wherein said force elements comprise pistons.

3. A loading and compacting device for the trash container of a trash-collecting vehicle, said container having a generally rectangular rear fill opening with upper and lower edges and opposite side edges and a loading bin at the rear of said container and extending to the lower edge of the fill opening, said device comprising an articulated plate having parallel first and second edges and substantially the same shape and dimensions as the fill opening, said plate being composed of upper and lower panels connected by a hinge extending parallel to the first and second edges;

a pair of swivel bearings connecting the first edge of the plate to the container at the side edges of the opening, said swivel bearings allowing movement of the plate parallel to said opening as well as swinging movement of the plate about a swivel axis toward and away from said opening;

a first force element connected between the container and the plate for swinging the plate about said swivel axis;

a second force element connected between the container and the plate for moving the plate parallel to said opening;

a third force element connected between the plate panels for pivoting the lower panel about said hinge, and control means for controlling said force elements to move said plate from a fully open position wherein said plate extends rearwardly from said upper edge of the fill opening so as to expose said opening and said bin, through a partially closed position wherein the second edge of the plate lies adjacent to the lower edge of the fill opening and the first and second panels define an acute angle, to a fully closed position wherein all three force elements combine to drive the first and second panels into alignment with said opening so that the panels exert a strong net compacting force directed perpendicular to said opening while at the same time substantially closing the opening.

4. The loading and compacting device defined in claim 3 wherein the pair of swivel bearings includes a pair of runners mounted adjacent to and extending parallel to the side edges of the fill opening, and a pair of bearing elements mounted to the first edge of the panel and being slidably engaged to the pair of runners.

5. The loading and compacting device defined in claim 4 wherein the device includes a pair of laterally spaced-apart second force elements connected between the container and the pair of bearing elements for moving the pair of bearing elements along the pair of runners so as to move the plate parallel to the fill opening.

6. The loading and compacting device defined in claim 4 wherein the device includes a pair of laterally-spaced-apart first force elements connected between the container and the plate for swinging the plate about the swivel axis.

7. The loading and compacting device defined in claim 4 wherein the device includes a pair of laterally spaced-apart third force elements connected between the plate panels for pivoting the lower panel about said hinge.

* * * * *